US006839033B2

(12) United States Patent
Shimabara et al.

(10) Patent No.: US 6,839,033 B2
(45) Date of Patent: Jan. 4, 2005

(54) MULTI-FREQUENCY ANTENNA

(75) Inventors: Masataka Shimabara, Warabi (JP); Mitsuya Makino, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/471,076

(22) PCT Filed: Dec. 20, 2002

(86) PCT No.: PCT/JP02/13385

§ 371 (c)(1),
(2), (4) Date: Sep. 5, 2003

(87) PCT Pub. No.: WO03/061063

PCT Pub. Date: Jul. 24, 2003

(65) Prior Publication Data

US 2004/0090386 A1 May 13, 2004

(30) Foreign Application Priority Data

Jan. 9, 2002 (JP) ..... 2002-002415

(51) Int. Cl.[7] ..... H01Q 1/24
(52) U.S. Cl. ..... 343/702; 343/895; 343/901
(58) Field of Search ..... 343/702, 725, 343/727, 895, 900, 901

(56) References Cited

U.S. PATENT DOCUMENTS 6,097,341 A * 8/2000 Saito ..... 343/702
6,198,448 B1 * 3/2001 Suzuki et al. ..... 343/725
6,266,018 B1 * 7/2001 Otomo ..... 343/702
6,339,401 B2 * 1/2002 Oshiyama ..... 343/702
6,369,764 B1 * 4/2002 Ishikawa ..... 343/702

FOREIGN PATENT DOCUMENTS

| | | |
|---|---|---|
| JP | 10-022729 | 1/1998 |
| JP | 10-112606 | 4/1998 |
| JP | 2000-147545 | 5/2000 |
| JP | 2000-307342 | 11/2000 |
| JP | 2001-016031 | 1/2001 |
| JP | 2002-330015 | 11/2002 |
| JP | 2003-087021 | 3/2003 |
| WO | WO 96/00990 | 1/1996 |

* cited by examiner

*Primary Examiner*—Tho Phan
(74) *Attorney, Agent, or Firm*—Kirk Hahn

(57) ABSTRACT

With the object of providing a mobile wireless equipment with a multi-frequency antenna capable of performing communication with a GPS system in addition to conventional communication with mobile wireless systems, an antenna 10 for mobile wireless equipment and a GPS antenna 4 are tightened together by threading an antenna fixing nut 19 onto a holder 7 from within a casing 101, after inserting a holder 7 of the antenna 10 for mobile wireless equipment from above a through-hole 4*b* of the GPS antenna 4 and inserting the holder 7, which projects from below, from above into an aperture 101*a* of the casing 101. Also, positioning and fixing of the GPS antenna 4 are performed by engagement of claws 41, 41 formed on the GPS antenna 4 and a positioning boss 42 with claw receiving sections 43, 43 and a boss receiving section 44 formed in the upper part of the casing 101.

1 Claim, 11 Drawing Sheets

MULTI-FREQUENCY ANTENNA

TECHNICAL FIELD

The present invention relates to a multi-frequency antenna provided in mobile wireless equipment such as a mobile telephone.

BACKGROUND ART

Recently, mobile wireless equipment such as mobile telephones has become common; such a mobile telephone is provided with an antenna for transmitting and receiving calls and/or information. Typically, this antenna is in the form of a whip antenna that can be freely extended/retracted and that can be accommodated in the casing of the mobile telephone for convenience in carrying when the mobile telephone is on standby.

However, since, when the whip antenna is accommodated in the casing, the mobile telephone is substantially incapable of transmission and reception, a helical antenna comprising a small coil element that is positioned outside the casing even when the whip antenna is accommodated in a casing may be provided at the tip of the whip antenna. In this way, when the whip antenna is accommodated in the casing, transmission and reception can be performed by using this helical antenna.

FIG. 11 shows an example of the construction of a prior art antenna for mobile wireless equipment in such an antenna for mobile wireless equipment.

In the case of the antenna 300 for mobile wireless equipment shown in this Figure, a linear whip antenna section 313 is freely slidably inserted into an antenna holder 314 made of metal such that the whip antenna section 313 can be freely extended and retracted with respect to the casing when the antenna holder 314 is fixed to the casing of the mobile wireless equipment. An insulating joint 312 that extends to a top section 310 is integrally formed passing through the interior of a top plug 311, at the tip of the whip antenna section 313, and a stop 315 made of metal is fixed to the other end thereof. The stop 315 is inserted into the antenna holder 314 when the whip antenna section 313 is extended, so that the whip antenna section 313 is electrically connected with the antenna holder 314 through the stop 315.

Also, the joint 312 is integrally formed at the tip of the whip antenna section 313 and is insertion-formed with the top plug 311 when this integral forming is performed. The top of this joint 312 is not shown in the drawings, but the top section 310 and the whip antenna section 313 are fixed such that the top of this joint 312 extends within the top section 310 and the top section 310 and the whip antenna section 313 are positioned substantially coaxially. In addition, although not shown, the top of the top plug 311, which is made of metal, is positioned within the top section 310, an end section of the helical antenna accommodated in the top section 310 being electrically connected therewith. In this way, when the whip antenna section 313 is accommodated, the helical antenna is electrically connected with the antenna holder 314 through the top plug 311 by insertion of the top plug 311 from above into the antenna holder 314.

However, in recent years, with the development and use of various types of mobile communications system, demands have increased for transmitting or receiving between a plurality of communications systems using a single item of mobile wireless equipment. For example, mobile wireless equipment is being demanded that is capable of receiving position measurement information from the GPS (Global Positioning System) system, in order to enable the user who is carrying the mobile telephone equipment to ascertain his current position, in addition to transmission/reception with a mobile wireless system as performed hitherto.

However, in order to achieve a construction that is capable of operation with a plurality of communication systems including the GPS system in a single item of mobile wireless equipment, it was necessary for example to incorporate a planar antenna for GPS or to install a small-volume chip antenna in the casing, in addition to the antenna 300 for the mobile wireless equipment, as shown in FIG. 11 described above; this therefore led to the problem of tending to increase the size of the mobile wireless equipment.

Also, there is the problem that, since the mobile wireless equipment is employed held in the user's hand, if a GPS antenna is provided in the casing, the proportion of the GPS antenna that is covered by the hand of the user holding the equipment becomes large, adversely affecting the electrical performance.

An object of the present invention is therefore to provide a multi-frequency antenna capable of performing communication with another communication system in addition to communication with the mobile wireless system, as hitherto, without causing deterioration of the electrical properties when employed by the user or increase in the overall size of the mobile wireless equipment.

DISCLOSURE OF THE INVENTION

In order to solve the above problem, a multi-frequency antenna according to the present invention comprises: a first antenna for mobile wireless equipment comprising a whip antenna section that can be freely extended from and accommodated into a holder having a flange and capable of operating in a first frequency band in an extended condition; and an antenna top section fixed through an insulating joint at the tip of this whip antenna section and comprising a first coil element capable of operating in the first frequency band in a condition projecting from the holder when the whip antenna section is accommodated; and a second antenna for mobile wireless equipment comprising a ring-shaped cover having a through-hole formed substantially in the center thereof and a step formed in this through-hole such that the diameter below this step becomes smaller; and a second coil element capable of operating in a second frequency band, and the holder is fixed to the casing by inserting the same within the through-hole that is formed in the cover in the second antenna for mobile wireless equipment, and the first antenna for mobile wireless equipment and the second antenna for mobile wireless equipment are thereby both fixed to the casing on engagement of the flange of the holder with the step within the through-hole.

Also, in the multi-frequency antenna according to the present invention a claw capable of engagement with a claw receiving section provided on the casing is formed so as to extend downwards from the cover and in that the second antenna for mobile wireless equipment is fixed to the casing by engagement of this claw with the claw receiving section.

Furthermore, in the multi-frequency antenna according to the present invention, a boss capable of insertion in a boss receiving section provided on the casing is formed so as to project from the undersurface of the cover, and in that when mounting the second antenna for mobile wireless equipment on the casing, the positioning is performed by inserting the boss in the boss receiving section.

Yet further, in the multi-frequency antenna according to the present invention, the shape of the antenna top section is determined such that the first coil element and the second coil element are separated by at least a prescribed distance when the whip antenna section is accommodated.

With the present invention as above, it becomes possible to receive positioning information from a GPS satellite by means of the second antenna for mobile wireless equipment accommodated in the ring-shaped case. Also, since an arrangement can be achieved such that the first antenna for mobile wireless equipment is inserted in a through-hole formed in substantially the center of the ring-shaped case, the multi-frequency antenna can be arranged in the upper part of the casing, thereby making it possible to prevent the casing becoming over-sized. Also, thanks to the arrangement thereof in the upper part of the casing, there is little likelihood of the multi-frequency antenna being covered by the hand of the user holding the equipment, so adverse effects on the electrical characteristics of the multi-frequency antenna can be prevented.

BRIEF DESCRIPTION OF THE DRAWINGS

FIG. 2(*b*) is a view showing the overall construction of the multi-frequency antenna during whip antenna accommodation according to an embodiment of the present invention.

FIG. 3(*b*) is a cross-sectional view with part of the multi-frequency antenna according to an embodiment of the present invention shown to a larger scale, when the whip antenna is accommodated.

BEST MODE FOR CARRYING OUT THE INVENTION

Figure 1:
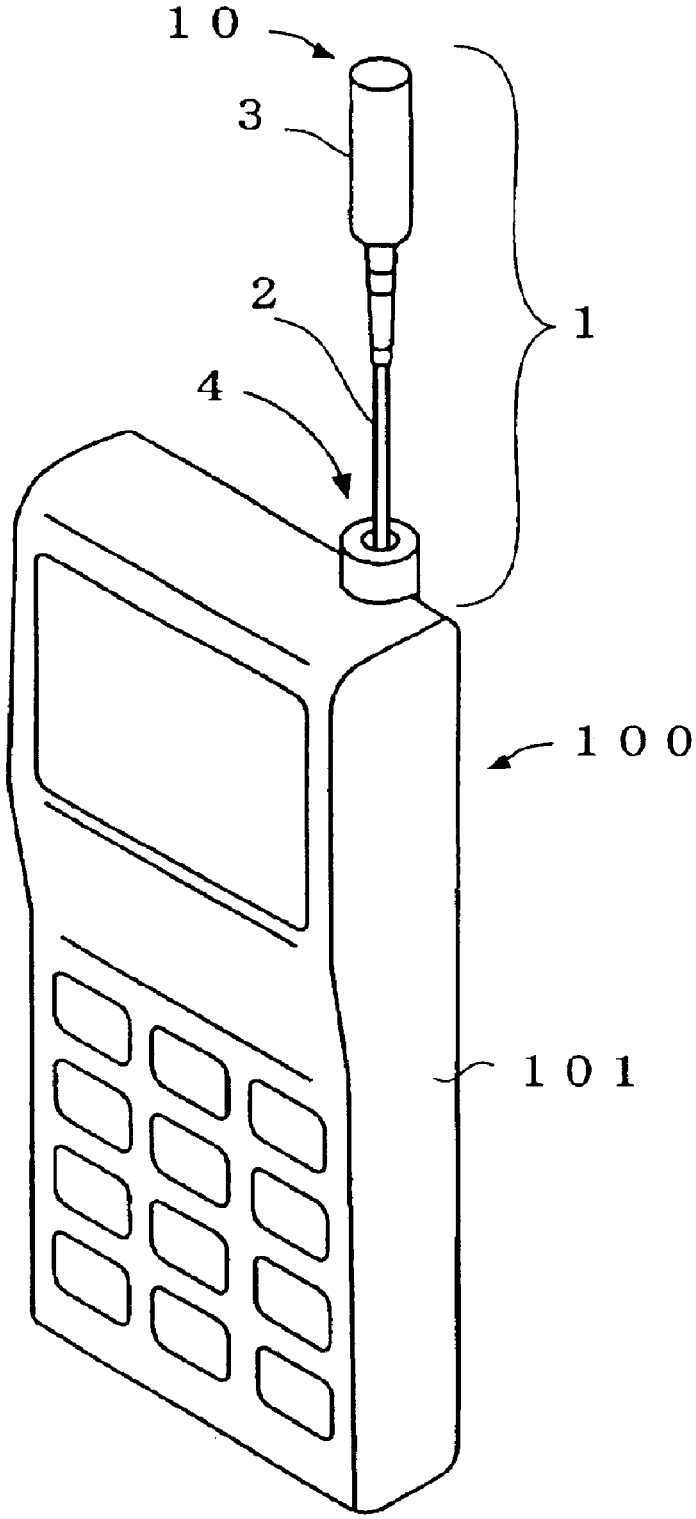
FIG. 1 is a view showing the construction of mobile telephone equipment comprising a multi-frequency antenna according to an embodiment of the present invention.
Figure 2A:
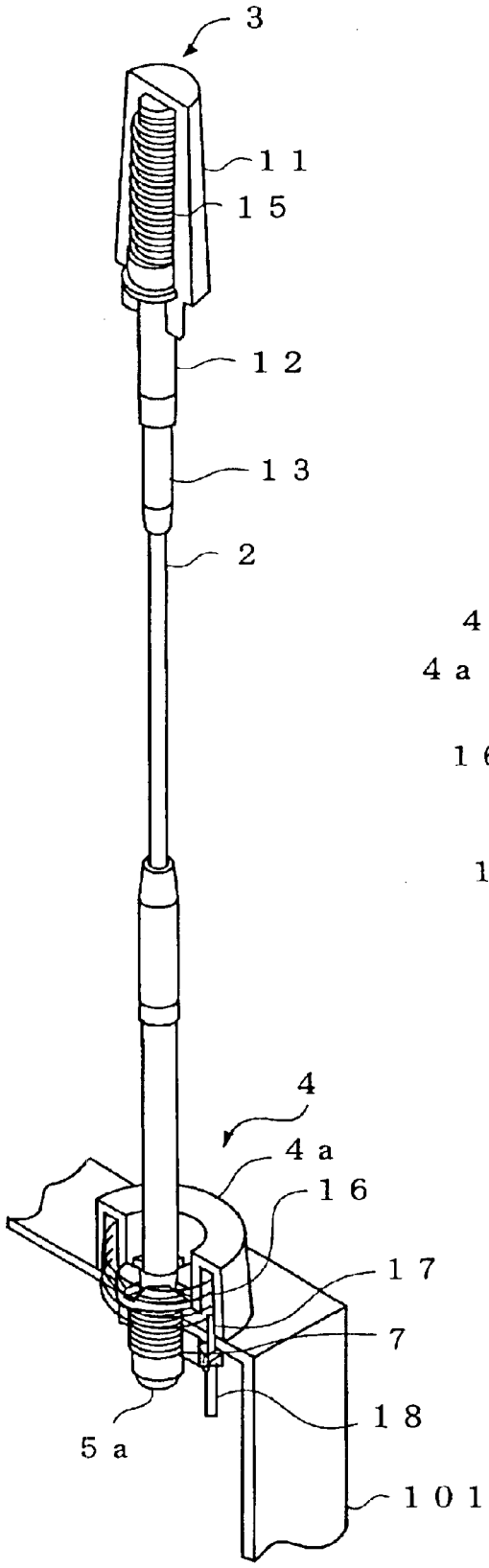
FIG. 2(*a*) is a view showing the overall construction of the multi-frequency antenna during whip antenna extension according to an embodiment of the present invention.
Figure 2B:
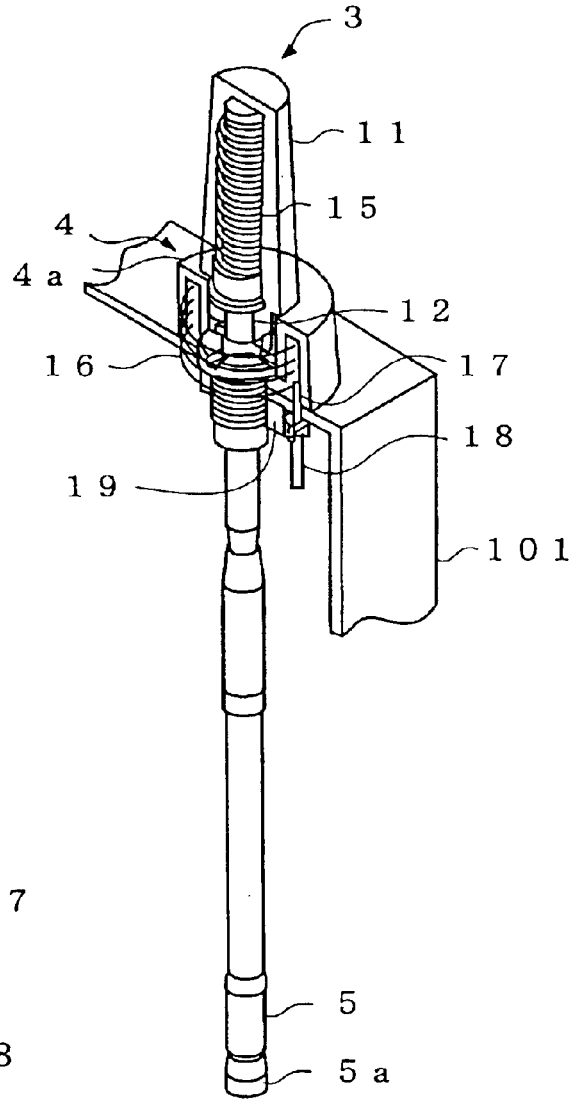
Figure 3B:
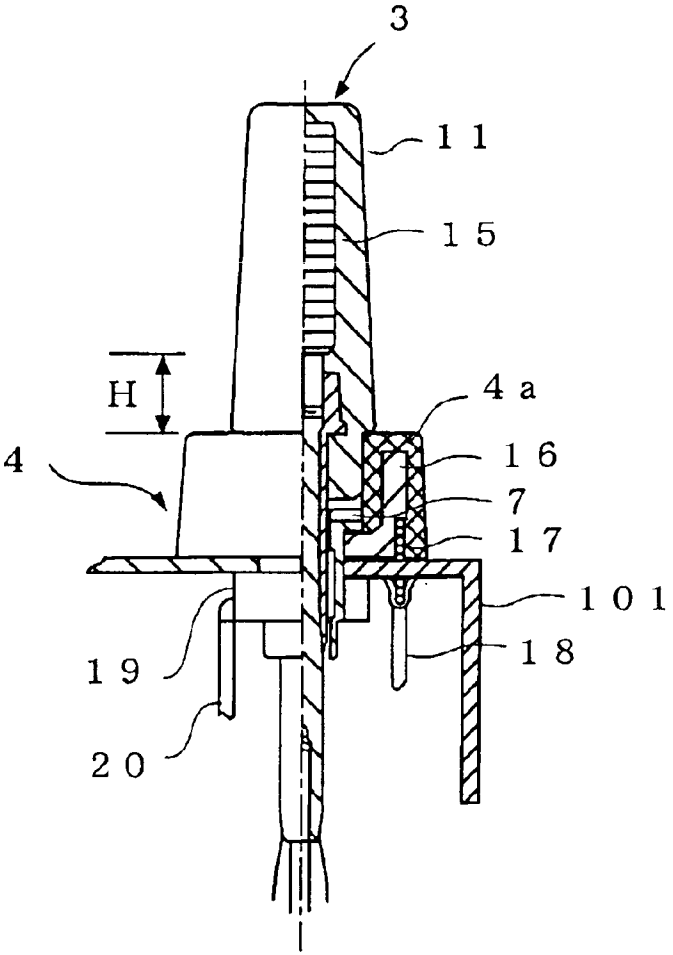
FIG. 3(*a*) is a cross-sectional view showing the construction of an antenna top section with part of the multi-frequency antenna according to an embodiment of the present invention shown to a larger scale.
Figure 3A:
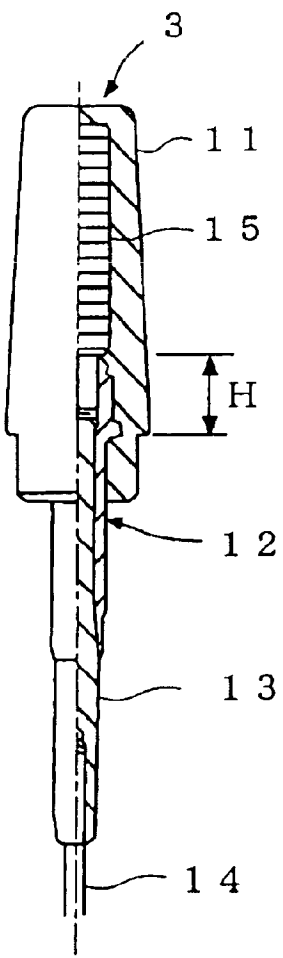
Figure 4:
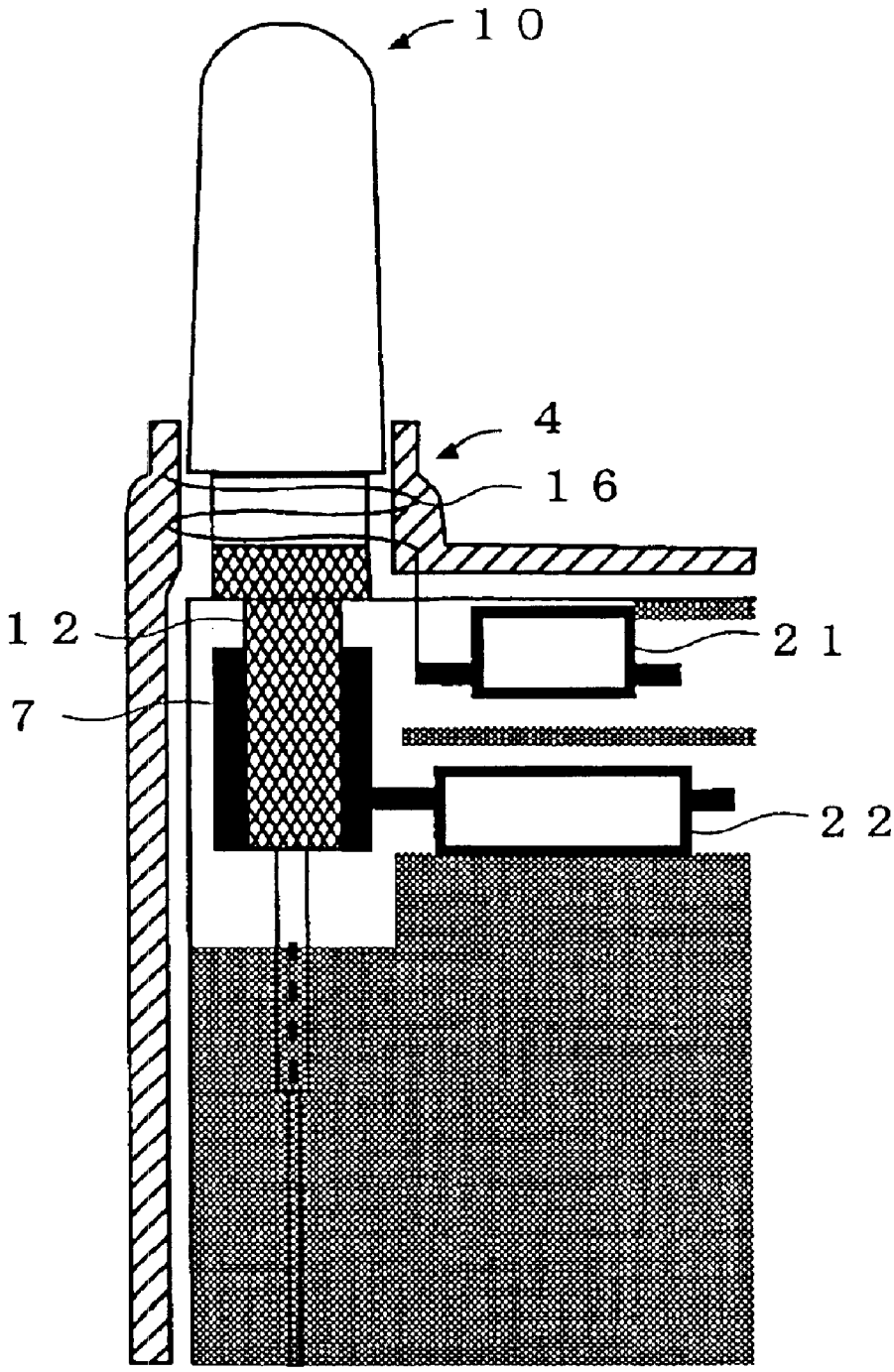
FIG. 4 is a view showing the electrical connections of the multi-frequency antenna according to an embodiment of the present invention.

FIG. 1 shows the construction of mobile telephone equipment comprising a multi-frequency antenna according to an embodiment of the present invention. FIG. 2 to FIG. 4 show the construction of a multi-frequency antenna according to an embodiment of the present invention.

A mobile telephone 100 shown in FIG. 1 comprises a casing 101 in which a telephone functional circuitry section and/or battery are accommodated; various buttons including a dialing button and a display are provided on the front face of the casing 101. An antenna 1 for multi-frequency use according to an embodiment of the present invention is provided on the upper face of the casing 101.

The antenna 1 for multi-frequency use comprises an antenna 10 for the mobile wireless equipment and a GPS antenna 4. The antenna 10 for the mobile wireless equipment is constructed so as to operate as a substantially non-directional monopole antenna in the horizontal plane and is provided in the mobile telephone 100 in order to perform wireless communication with a wireless telephone base station on the ground.

In contrast, the GPS antenna 4 is constructed so as to operate as a circularly polarized antenna having a circularly polarized radiation characteristic in the perpendicular direction and is provided so as to be able to receive electromagnetic waves from a GPS satellite in the mobile telephone 100. In this case, the GPS antenna 4 is of ring-shaped form with the antenna 10 for the mobile wireless equipment extending from substantially the center thereof.

FIG. 2(*a*) shows the extended condition of the whip antenna section 2 of the antenna 10 for the mobile wireless equipment. In this case, a linear whip antenna section 2 of a construction extending in two stages provided beneath an antenna top section 3 is in operating condition.

That is, the lower end of the whip antenna section 2 is held by being inserted from below in a holder 7 made of metal that is fixed in the casing 101. It should be noted that, as shown in FIG. 2(*b*), a stop 5 that is of fairly large diameter is fixed to the bottom end of the whip antenna section 2, an abutment section 5*a* illustrated at the bottom end of this stop 5 being formed thereon. In this way, when the whip antenna section 2 is extended, the abutment section 5*a* abuts the undersurface of the holder 7 so that the whip antenna section 2 cannot be further extended.

In the extended condition, the whip antenna section 2 is electrically connected with the holder 7 through the stop 5. The holder 7 is connected with a wireless circuit, not shown, within the casing 101. That is, when the whip antenna section 2 is extended, the whip antenna section 2 is electrically connected with the wireless circuit within the casing 101.

Also, as shown in FIG. 2(*b*), when the whip antenna section 2 is accommodated in the casing 101, a coil element 15 within a cap 11 that is electrically connected with the top plug 12 is put in operating condition by insertion of the top plug 12 from above into the holder 7. That is, the helical antenna within the antenna top section 3 is put in operating condition. In this way, when the whip antenna section 2 is accommodated, the coil element 15 of the antenna top section 3 is electrically connected with the holder 7 through the top plug 12, and is thereby connected with the wireless circuit within the casing 101.

Also, a GPS antenna 4 is constructed by accommodating a GPS element 16 that is coiled in the form of a coil within a ring-shaped GPS cover 4*a*. One end of this GPS element 16 is in contact with the casing feed terminal 18 in the casing 101 through a coil feed terminal 17 and is connected with a GPS circuit, not shown, within the casing 101 through this casing feed terminal 18. That is, a helical antenna for circularly polarized reception in the GPS cover 4*a* is normally connected with the GPS circuit in the casing 101.

Next, FIG. 3 shows a cross-sectional view illustrating the construction of the antenna top section 3 and the GPS antenna 4 according to an embodiment of the present invention.

FIG. 3(*a*) is a cross-sectional view showing the construction of the antenna top section 3. As shown in FIG. 3(*a*), the antenna top section 3 is constructed by integrally forming a cap 11 made of resin at the top of an electrically conductive top plug 12, a coil element 15 being accommodated within the cap 11. The coil element 15 is constructed for example by forming a conductive film within a helical groove formed in the outer circumferential surface of an insulating rod-shaped body. The bottom end of this coil element 15 is electrically connected with the top of the top plug 12, made of metal, in the shape of an elongate pipe. Also, an insulating joint 13 is inserted into the top plug 12, the head thereof being engaged with a step formed in the top plug 12. Also, the tip of a linear whip element 14 made of highly resilient metal or the like is fixed by being integrally formed at the bottom end of the joint 13. The whip antenna section 2 is constructed by insertion of a flexible tube made of vinyl or the like into the linear whip element 14.

FIG. 3(*b*) is a cross-sectional view showing the construction of the antenna top section 3 when the whip antenna is accommodated.

As shown in this Figure, the GPS antenna 4 is constructed by arranging for a coil-shaped GPS element 16 formed by conductive material such as for example phosphor-bronze to be covered by a GPS cover 4*a* made of non-conductive ABS resin or the like formed in ring shape. A coil feed terminal 17 leads from the GPS element 16 and is electrically connected by insertion of the tip of this coil feed terminal 17 in the casing feed terminal 18 within the casing 101. In this way, if the GPS cover 4*a* is formed by ABS resin or the like, processing of the shape thereof or coloration is facilitated, so the external appearance of the GPS antenna 4 can be made of a design matching the casing of the mobile wireless equipment. The antenna 10 for the mobile wireless equipment is electrically connected with the mobile wireless circuit within the casing 101 through a feed terminal 20.

When the whip antenna 2 is accommodated, the step that is formed in the external circumferential surface of the cap 11 of the antenna top section 3 abuts the top end of the GPS cover 4*a* so that the portion below the step is accommodated in a through-hole 4*b* of the GPS antenna 4. If, at this point, the distance between the coil element 15 that is accommodated in the antenna top section 3 and the GPS element 16 in the GPS antenna 4 is too close, high-frequency coupling occurs between the two elements, adversely affecting the electrical properties of the coil element 15 and GPS element 16. Accordingly, in the present embodiment, it is arranged to prevent deterioration of the electrical properties of the GPS antenna 4 by formation thereof with the length of the lower part of the cap 11 adjusted such that the distance H from the bottom end of the coil element 15, which is accommodated in the antenna top section 3, as far as the step of the cap 11 is a prescribed distance. The relationship between the distance H between the coil element 15 and the GPS element 16 and the gain of the GPS antenna 4 will be described later.

The electrical connection relationship of the antenna 1 for multi-frequency use according to the present embodiment and the circuitry within the casing 101 is as shown in FIG. 4.

Feed to the antenna 10 for the mobile wireless equipment and the GPS antenna 4 according to the present embodiment is performed from the two locations of the mobile wireless equipment circuit, not shown, and the GPS circuit. As shown in FIG. 4, the GPS antenna 4 is then enabled to operate efficiently by adjusting the impedance of the GPS antenna 4 and the GPS circuit by providing a matching circuit 21 for the GPS antenna, if required, between the GPS element 16 and the GPS circuit, not shown.

Likewise also, efficient operation of the antenna 10 for the mobile wireless equipment can be achieved by performing impedance matching of the antenna 10 for the mobile wireless equipment and the mobile wireless circuit, if required, by providing a matching circuit 22 for the mobile wireless equipment antenna between the holder 7 of the antenna 10 for the mobile wireless equipment and the mobile wireless circuit.

Figure 5:
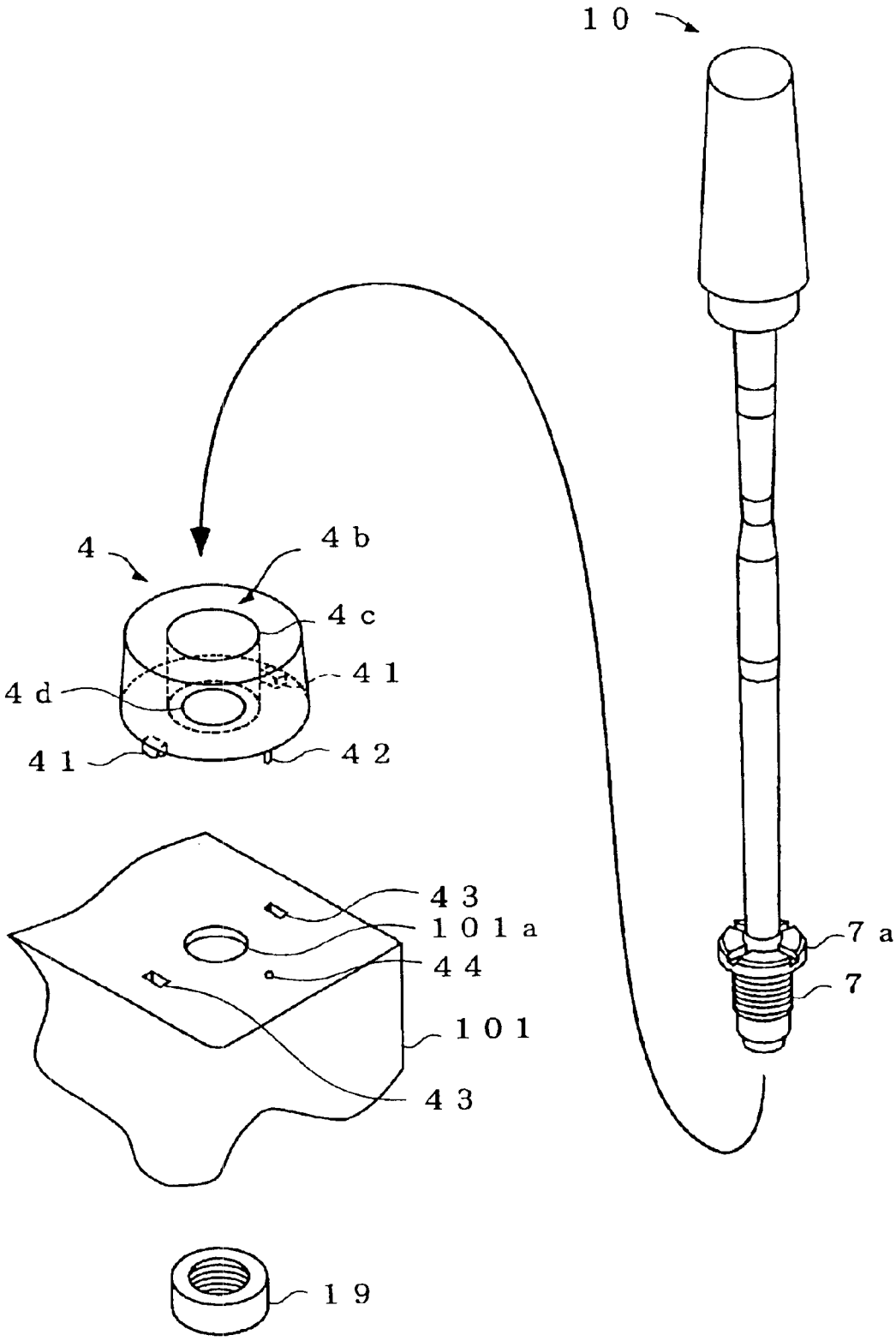
FIG. 5 is an exploded view of the multi-frequency antenna according to an embodiment of the present invention.

Next, in order to assemble the antenna 1 for multi-frequency use according to the embodiment of the present invention, first of all, as shown in FIG. 5, the holder 7 of the antenna 10 for the mobile wireless equipment is inserted from above the through-hole 4*b* of the GPS antenna 4. A step is formed within the through-hole 4*b* and the diameter of the aperture 4*d* at the bottom end is formed smaller than the diameter of the aperture 4*c* at the top end. That is, when the antenna 10 for the mobile wireless equipment is inserted from above the through-hole 4*b*, the bottom portion of the holder 7 projects from the aperture 4*d* in a condition in which a flange 7*a* of the holder 7 abuts the step within the through-hole 4*b*. Next, the holder 7 that is projecting from the aperture 4*d* is inserted from above into an aperture 101*a* of the casing 101 for antenna mounting and an antenna fixing nut 19 is threaded onto the holder 7 from the inside of the casing 101. In this way, the antenna 10 for the mobile wireless equipment and the GPS antenna 4 are fixed in the upper part of the casing 101 by common tightening of the antenna 10 for the mobile wireless equipment and the GPS antenna 4.

Figure 6:
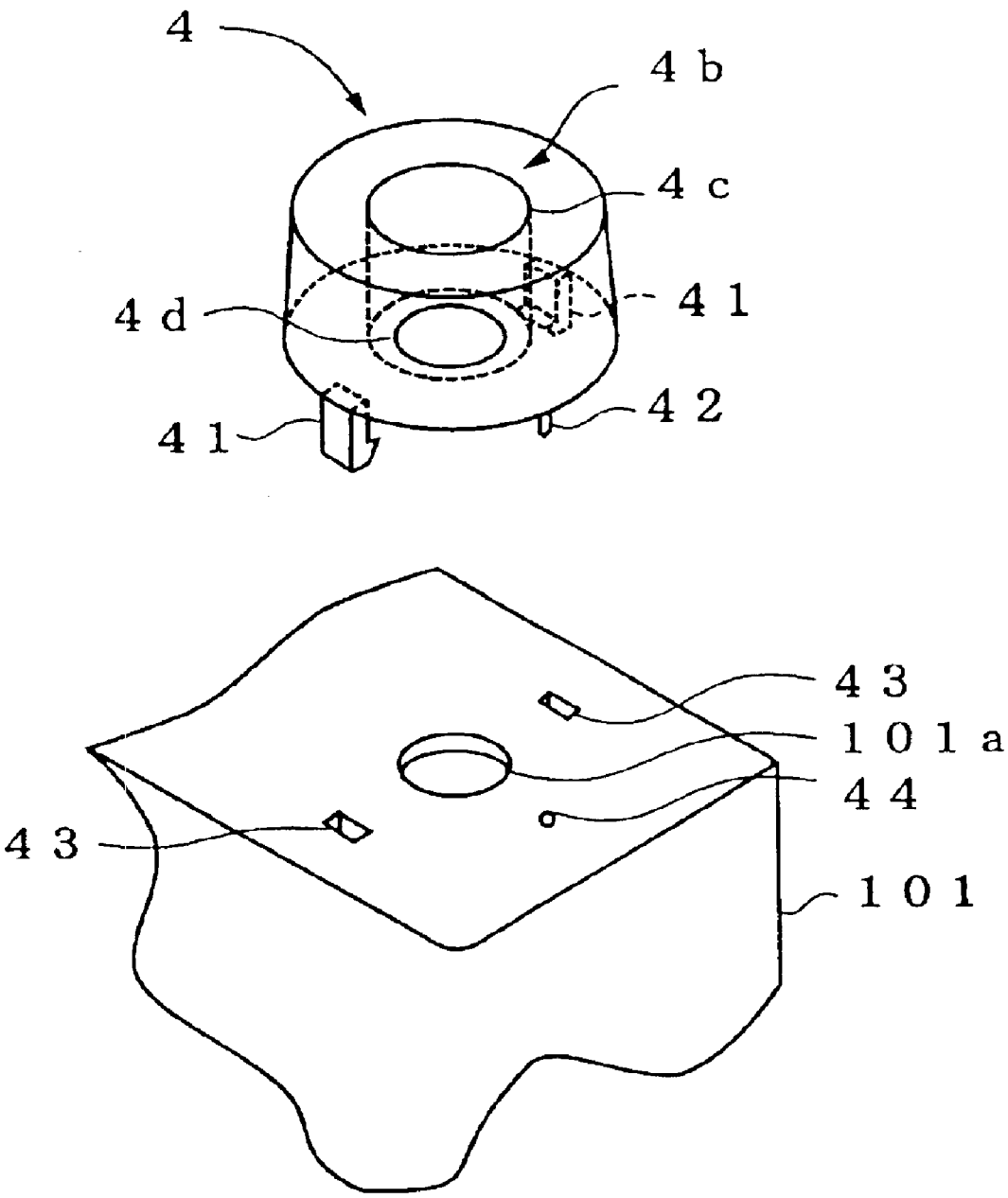
FIG. 6 is a view showing to a larger scale the construction of the GPS antenna of the multi-frequency antenna according to an embodiment of the present invention.

Also, in the antenna 1 for multi-frequency use according to the present embodiment, as shown in FIG. 5 and FIG. 6, a pair of claws 41, 41 and a boss 42 for positional location are formed so as to project from the undersurface of the GPS cover 4*a* of the GPS antenna 4. These pair of claws 41, 41 and boss 42 for positional location are capable of engagement with or insertion in a pair of claw receiving sections 43, 43 that receive the claws of 41, 41 of the GPS antenna 4 and a boss receiving section 44 that receives the boss 42 of the GPS antenna 4, formed on the upper surface of the casing 101. Thus, positional location of the GPS antenna 4 can be achieved by mating the boss 42 of the GPS antenna 4 with the boss receiving section 44 of the casing 101 when mounting the antenna 1 for multi-frequency use at the upper part of the casing 101. Also, when the antenna 1 for multi-frequency use is mounted at the upper part of the casing 101, the GPS antenna 4 may be temporarily fixed with respect to the casing 101 by engagement of the pair of claws 41, 41 of the GPS antenna 4 with the pair of claw receiving sections 43, 43 of the casing 101. In this way, an antenna fixing nut 19 can easily be threaded onto the holder 7 from within the casing 101.

It should be noted that, although, in the present embodiment, an example was described in which a pair of claws 41, 41 and claw receiving sections 43, 43 were respectively provided on the GPS antenna 4 and the casing 101, this is merely an example, and three or more claws 41 and claw receiving sections 43 could be provided on the GPS antenna 4 and the casing 101.

Incidentally, the antenna 1 for multi-frequency use according to the present invention can be designed as an antenna adapted to various frequency bands, by setting the antenna lengths of the antenna 10 for the mobile wireless equipment and the GPS antenna 4 to a length appropriate to the wavelength λ of the desired frequency band, for example ¼λ or ⅜λ or ⅝λ.

Furthermore, by providing the antenna 10 for the mobile wireless equipment with an antenna matching circuit 22 for the mobile wireless equipment, an antenna adapted to a plurality of frequency bands can be achieved.

Figure 7A:
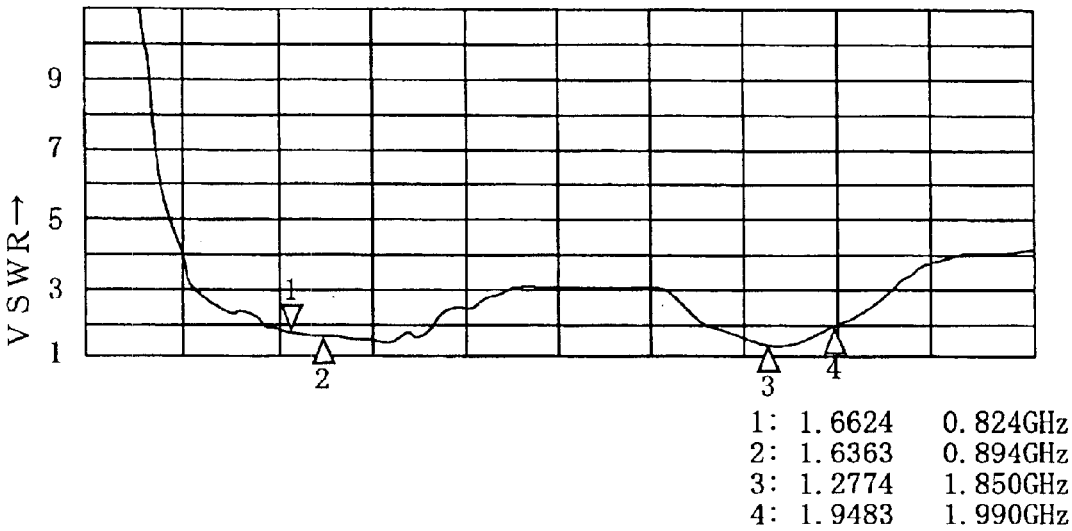
FIGS. 7(*a*) and (*b*) are views showing an example of the impedance characteristic of the multi-frequency antenna according to an embodiment of the present invention.
Figure 7B:
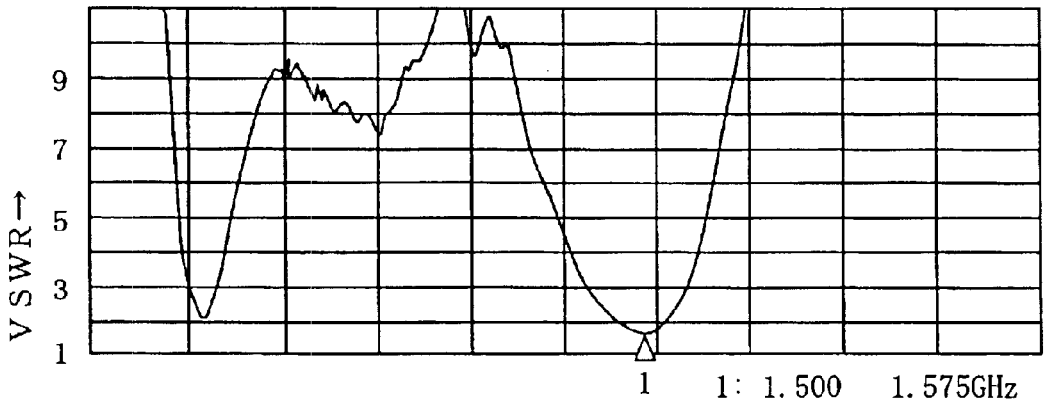

FIG. 7 shows an example of the impedance characteristic of an antenna 1 for multi-frequency use according to an embodiment of the present invention.

FIG. 7(*a*) shows the VSWR (voltage standing wave ratio) of the antenna 10 for the mobile wireless equipment and FIG. 7(*b*) shows the VSWR characteristic of the GPS antenna 4, respectively.

In the case of the antenna 10 for the mobile wireless equipment shown in FIG. 7(*a*), respectively excellent VSWR characteristics are obtained in the 800 MHz band and 1.9 GHz band, which are used as the frequency bands of mobile telephone networks, by providing an antenna matching circuit 22 for the mobile wireless equipment. Also, in the case of the GPS antenna 4 shown in FIG. 7(*b*), an excellent VSWR characteristic is obtained in the 1.5 GHz band, which is used as the frequency band for GPS.

That is, with the antenna 1 for multi-frequency use according to the present embodiment, a multi-frequency antenna can be constituted that is capable of operating in the three frequency bands: 800 MHz band, 1.5 GHz band and 1.9 GHz band, for example. Consequently, mobile wireless equipment able to cope with three communications systems can be constructed by mounting such an antenna 1 for multi-frequency use at the upper part of the mobile wireless equipment.

Of course, the frequency bands in which the antenna 1 for multi-frequency use according to the present embodiment is capable of operating are merely examples and it would be possible for example to construct a multi-frequency antenna capable of operating in the frequency band of the GPS antenna 4 and other frequency bands of the mobile wireless equipment.

Figure 8:
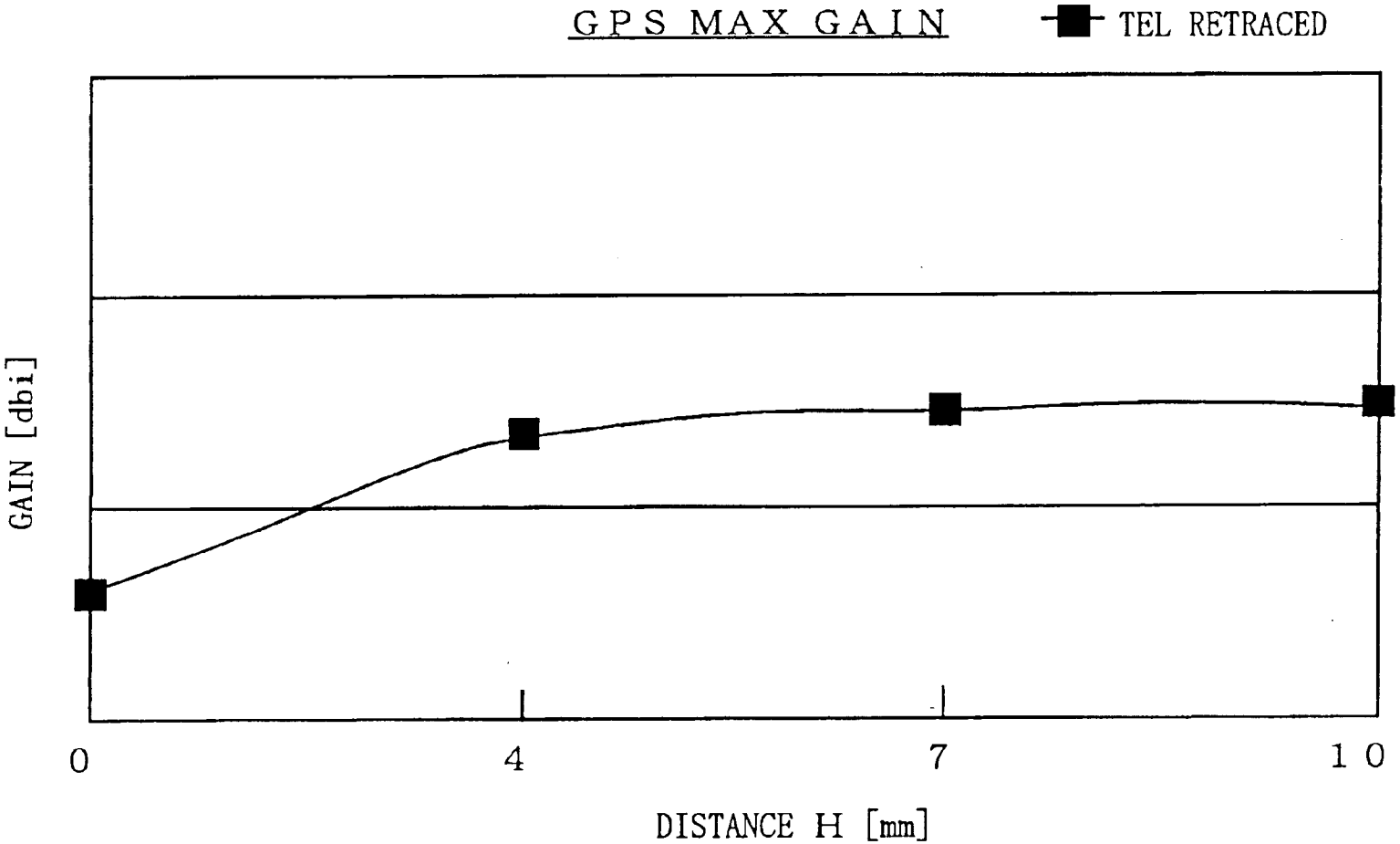
FIG. 8 is a view showing the relationship between the distance between the coil element and the GPS element when the whip antenna of the multi-frequency antenna according to an embodiment of the present invention is accommodated, and the gain of the GPS antenna.

Next, FIG. 8 shows the relationship between the distance between the coil element 15 and GPS element 16 when the whip antenna is accommodated and gain of the GPS antenna 4.

As shown in this FIG. 8, as the distance H between the coil element 15 and GPS element 16 is made larger, high frequency coupling of the coil element 15 and GPS element 16 becomes more difficult, so the gain of the GPS antenna 4 can be taken as the gain when the GPS antenna 4 is employed on its own. In particular, by setting the distance H to at least 4 mm, high frequency coupling between the coil element 15 and GPS element 16 is substantially eliminated, making it possible to maintain the gain of the GPS antenna 4 substantially at its maximum.

Also, although a top helical type antenna was taken as an example in which an antenna 10 for mobile wireless equipment according to the present embodiment described up to this point was provided with a coil element 15 at a position at the tip of the whip antenna section 2 but electrically isolated from the whip antenna section 2 and in which, during extension of the whip antenna, the whip antenna section 2 was arranged to be operable and, during whip antenna accommodation, the coil element 15 of the antenna top section 3 was arranged to be operable, respectively, this is merely an example and an antenna 10 for mobile wireless equipment of another construction could also be employed.

Figure 9:
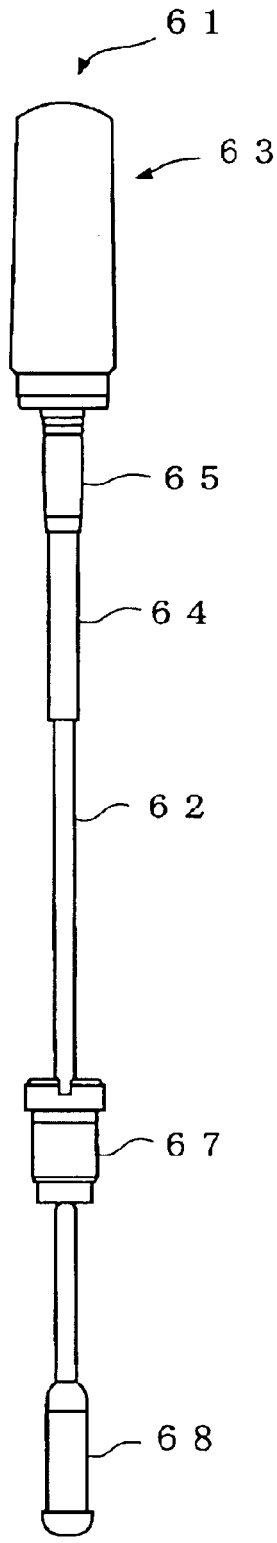
FIG. 9 is a view showing another construction of an antenna for mobile wireless equipment of a multi-frequency antenna according to an embodiment of the present invention.
Figure 10A:
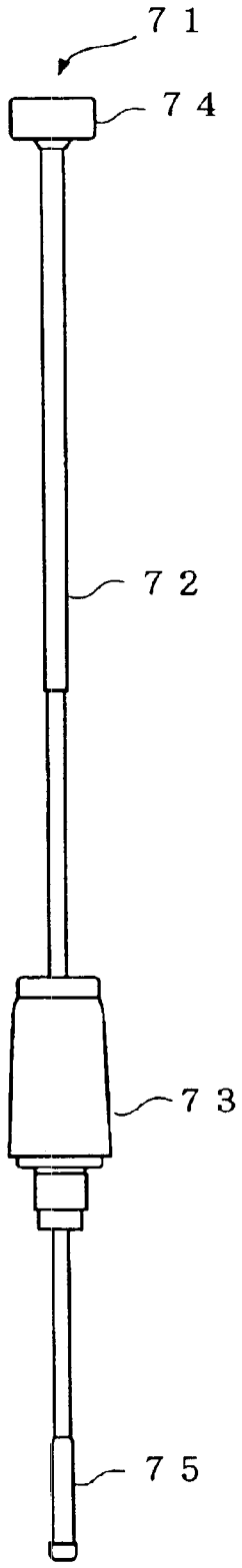
FIG. 10(*a*) and (*b*) are views showing yet another construction of an antenna for mobile wireless equipment of a multi-frequency antenna according to an embodiment of the present invention.
Figure 10B:
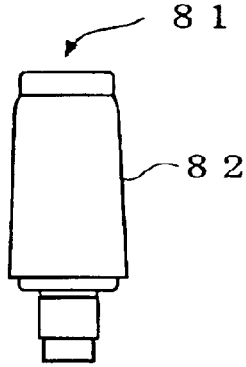
Figure 11:
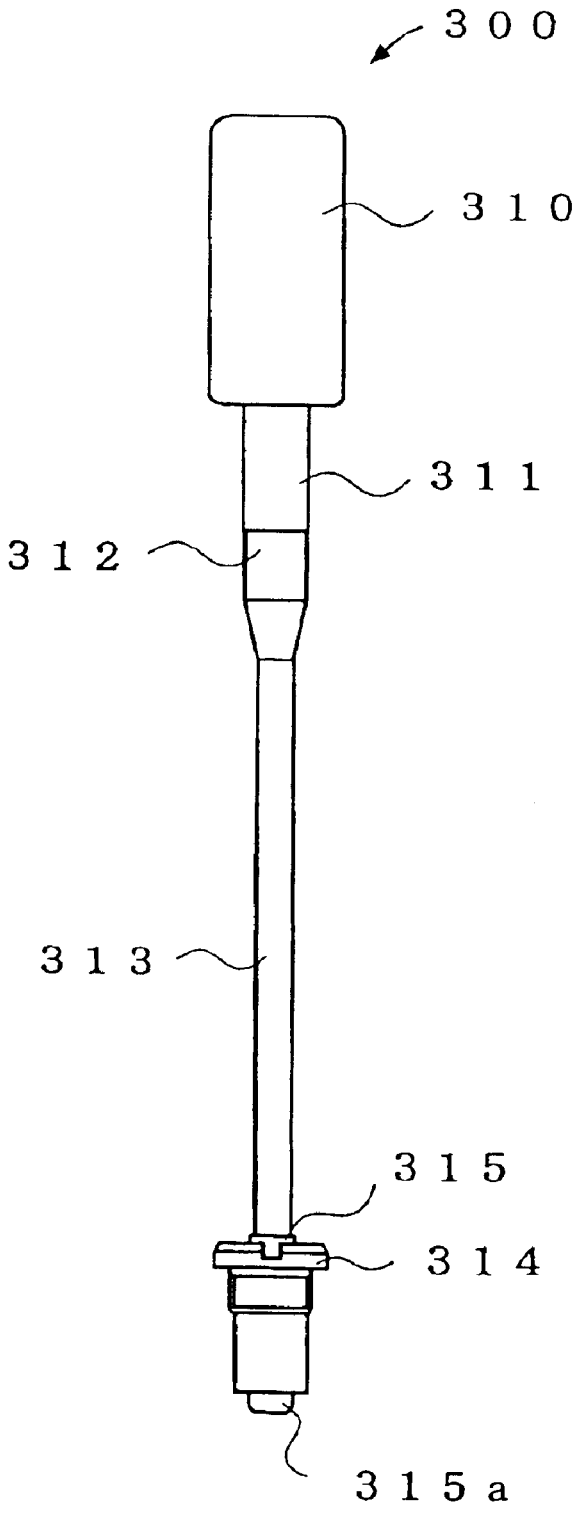
FIG. 11 Prior art
FIG. 11 is a view showing an example of the construction of a prior art antenna for mobile wireless equipment.

The construction of another antenna for mobile wireless equipment capable of use with a multi-frequency antenna according to the present invention is shown in FIG. 9 and FIG. 10.

FIG. 9 shows another constructional example of a top helical antenna capable of use as an antenna for mobile wireless equipment in a multi-frequency antenna according to the present invention.

Whereas the top helical antenna that was described up to this point is a two-section antenna wherein the length of the whip antenna section 2 becomes shorter when the whip antenna is accommodated, the antenna 61 for mobile wireless equipment shown in FIG. 9 is a single-section antenna in which the whip antenna section 62 cannot be shortened when the whip antenna is accommodated.

Specifically, in the case of the antenna 61 for mobile wireless equipment shown in FIG. 9, when the whip antenna section 62 is freely slidably inserted in the holder 67 and the holder 67 is fixed in the casing of the mobile wireless equipment, the whip antenna section 62 can be accommodated within the casing with respect to the casing. An insulating joint 64 that extends to the antenna top section 63 passing through the interior of the top plug 65 is integrally formed at the tip of the whip antenna section 62 and a stop 68 is fixed at the other end thereof. The stop 68 is inserted in the holder 67 when the whip antenna section 62 is extended and the whip antenna section 62 is thereby electrically connected with the holder 68 through the stop 68. Also, the joint 64 is integrally formed with the tip of the whip antenna 62 and insertion forming with the top plug 65 is performed during this integral forming. Thus, the antenna top section 63 and the whip antenna section 62 are fixed at the top of this joint 64. Furthermore, the top of the top plug 65 is electrically connected to the end section of the helical antenna accommodated in the antenna top section 63. In this way, electrical connection of the helical antenna with the holder 67 through the top plug 65 is achieved by insertion of the top plug 65 from above into the holder 67 when the whip antenna section 62 is accommodated.

Also, the antenna 71 for mobile wireless equipment shown in FIG. 10(*a*) is an antenna of the extensible helical type in which a fixed-type antenna 73 that is provided with a coil element is positioned below the whip antenna section 72.

In this case, the whip antenna section 72 is freely slidably inserted in the fixed antenna section 73 so, when the fixed antenna section 73 is fixed to the casing of the mobile wireless equipment, the whip antenna section 72 can be accommodated within the casing with respect to the casing. Also, stops 74 and 75 are respectively provided at the tip and at the rear end of the whip antenna section 72.

Also, the antenna 81 for the mobile wireless equipment shown in FIG. 10(*b*) is a fixed-type antenna constituted by a fixed-type antenna section 82 that cannot be extended; such a fixed-type antenna 81 for mobile wireless equipment can also be employed as an antenna 10 for mobile wireless equipment.

Furthermore, it should be noted that, when selecting an antenna for mobile wireless equipment as shown in FIG. 10(*a*) and (*b*), a GPS antenna 4 could be employed formed with a large through-hole capable of allowing insertion of the bottom of a fixed-type antenna section 73 or fixed-type antenna section 82. Furthermore, the coil element that is accommodated in the fixed-type antenna section 73 or fixed-type antenna section 82 could be of a shape that enables the separation thereof to be maintained, so that high frequency coupling with the GPS element section 16 does not occur.

Industrial Applicability

As described above, with the present invention, positioning information from the GPS satellite can be received using a second antenna for mobile wireless equipment that is accommodated in a ring-shaped case. Thus, it is possible to prevent the casing becoming over-sized, since the multi-frequency antenna can be arranged at the upper part of the casing, as the arrangement can be made such that a first antenna for mobile wireless equipment is inserted in a through-hole formed substantially in the center of the ring-shaped case. In this way, mobile wireless equipment of small size can be obtained, since communication can be performed with a plurality of communication systems including GPS.

Also, since the multi-frequency antenna according to the present invention is made capable of mounting at the upper part of the casing, even when employed held in the hand of the user as conventionally, there is very little likelihood of the second antenna for mobile wireless equipment i.e. the GPS antenna being covered by the hand of the user who is holding the equipment, so an adverse effect on the electrical properties thereof can be prevented

What is claimed is:

1. A multi-frequency antenna comprising:

a first antenna for mobile wireless equipment comprising a whip antenna section that can be freely extended from and accommodated into a holder having a flange and capable of operating in a first frequency band in an extended condition; and an antenna top section fixed through an insulating joint at the tip of this whip antenna section and comprising a first coil element capable of operating in said first frequency band in a condition projecting from said holder when said whip antenna section is accommodated; and a second antenna for mobile wireless equipment comprising a ring-shaped cover having a through-hole formed substantially in the center thereof and a step formed in this through-hole such that the diameter below this step becomes smaller; and a second coil element capable of operating in a second frequency band;

characterized in that said holder is fixed to the casing by inserting the same within said through-hole that is formed in said cover in said second antenna for mobile wireless equipment, and said first antenna for mobile wireless equipment and said second antenna for mobile wireless equipment are thereby both fixed to said casing on engagement of said flange of said holder with said step within said through-hole; and characterized in that the shape of said antenna top section is determined such that said first coil element and said second coil element are separated by at least a prescribed disfrance when said whip antenna section is accommodated.

* * * * *